US005168587A

United States Patent [19]

Shutes

[11] Patent Number: 5,168,587

[45] Date of Patent: Dec. 8, 1992

[54] PATIENT POSITIONING DEVICE

[76] Inventor: Robert S. Shutes, 115 Sixth St., Cloquet, Minn. 55720

[21] Appl. No.: 884,382

[22] Filed: May 18, 1992

[51] Int. Cl.[5] ..... A61G 7/10

[52] U.S. Cl. ..... 5/81.1; 5/88.1

[58] Field of Search ..... 5/81.1–89.1, 5/600, 607

[56] References Cited

U.S. PATENT DOCUMENTS

| | | | |
|---|---|---|---|
| 1,334,901 | 3/1970 | Higdon | 5/81.1 |
| 2,812,524 | 11/1957 | Pruitt | 5/607 |
| 3,302,219 | 2/1967 | Harris . | |
| 3,488,098 | 1/1970 | Sobczak . | |
| 3,827,089 | 8/1974 | Grow | 5/607 |
| 3,874,010 | 4/1975 | Geary . | |
| 3,884,225 | 5/1975 | Witter | 5/81.1 |
| 3,895,403 | 7/1975 | Davis | 5/81.1 |
| 3,924,281 | 12/1975 | Gibbs | 5/81.1 |
| 4,180,879 | 1/1980 | Mann | 5/621 |
| 4,361,918 | 12/1982 | Roisseth | 5/81.1 |
| 4,459,712 | 7/1985 | Pathan | 5/81.1 |
| 4,490,867 | 1/1985 | Gabrielson | 5/109 |
| 4,502,169 | 3/1985 | Persson | 5/88.1 |
| 4,675,925 | 6/1987 | Littleton | 5/607 |
| 4,751,918 | 6/1988 | Bernard et al. | 128/57 |
| 4,776,047 | 10/1988 | DiMatteo | 5/81.1 |
| 4,872,226 | 10/1989 | Lonardo | 5/89.1 |
| 4,937,901 | 7/1990 | Brennan | 5/81.1 |
| 4,939,801 | 7/1990 | Schaal et al. | 5/607 |
| 5,018,225 | 5/1991 | Fergni et al. | 5/607 |
| 5,068,931 | 12/1991 | Smith | 5/84.1 |

FOREIGN PATENT DOCUMENTS

| | | |
|---|---|---|
| 85108331 | 6/1987 | China . |
| 7707425 | 2/1980 | Czechoslovakia . |
| 3509262 | 3/1985 | Fed. Rep. of Germany . |
| 2350831 | 1/1978 | France . |
| 2624007 | 6/1989 | France . |
| 1447163 | 8/1976 | United Kingdom . |

*Primary Examiner*—Alexander Grosz
*Attorney, Agent, or Firm*—Haugen and Nikolai

[57] ABSTRACT

A patient positioning device for manipulating mobility impaired patients is disclosed. A specially dimensioned corset adapted to be positioned around the torso of the patient is coupled to a flexible strap which is routed via bed frame mounted guides to a drive assembly located beneath the bed's mattress. The flexible strap is of a length sufficient to permit it to extend from the corset and over the a conventional hospital bed protective side rails to the drive assembly.

A variety of motors and drive systems are disclosed. One alternative features a reversible motor connected to a double roller mechanism. The strap is wound on a separate one of the rollers, so as the drive shaft rotates in one direction, one roller winds the strap upon itself while the other roller plays out a section of strap. Alternatively, a traveling block to which the strap is coupled pulls on one strap end while it feeds out the other.

12 Claims, 3 Drawing Sheets

PATIENT POSITIONING DEVICE

BACKGROUND OF THE INVENTION

I. Field of the Invention

This invention relates generally to equipment to assist a mobility impaired patient to be moved, and more particularly to a device for rotating or repositioning a mobility impaired patient while in bed and for maintaining a variety of positions with little or no assistance from medical personnel. It features a cuff or corset positioned about the patient's torso and/or hips and a pair of straps joined to a power take-up apparatus. As one strap is retracted by that apparatus, the other is released, enabling the mobility impaired patient to be rotated and/or shifted laterally on the bed surface.

II. Discussion of the Prior Art

Patients are mobility impaired for a wide variety of reasons, all of which render the patient dependent upon caregivers for manual assistance in changing their position in bed. These patients live in a wide variety of settings, including hospitals, nursing homes, rehabilitation centers, hospices, and their own homes. Whether due to disease or accident, these patients share the misfortune of an inability to move effectively in bed for their own comfort and to avoid developing decubitus ulcers. Regular, periodic movement of these patients by their caregivers is, thus, necessary, but it is a laborious task for the caregivers. Frequently, it requires that two or more aides manually lift the patient, resulting in a concomitant risk of back-related injuries in the caregivers. Furthermore, in many medical settings, such as hospitals and nursing homes, the task of repositioning a patient is time consuming, thereby reducing the time available for other patient care needs. Various prior art approaches for mechanically turning a patient have generally included either turning the patient or turning the bed on which the patient lies.

Numerous mechanized devices are available which turn a patient utilizing movement of an underlying soft, flexible material. All are mechanized variants of the turning sheet and pad positioned underneath the patient that was commonly used at the beginning of this century. When it became necessary to turn the patient, a caregiver would pull at the edges of the turning sheet and a frictional engagement would cause the patient to be rolled on the pad, as disclosed in U.S. Pat. No. 1,334,901, issued to Higdon. More recent variants of this apparatus utilize essentially the same principle, but have substituted a mechanized force for that exerted by the caregiver.

An example of an apparatus for turning a person confined to a bed is disclosed in U.S. Pat. No. 4,502,169, issued to Persson. This apparatus includes an adjustable frame which is applied to a bed. This frame supports selectively rotatable rolls positioned at the level of the bed mattress, which are connected to an electric motor. A draw sheet extends between the rolls, across the upper side of the bed and is wound on both rolls. The patient lies on top of the draw sheet. When an electric motor is turned on by a patient or nurse, the draw sheet is pulled in the preselected direction, and the patient is turned by friction produced between his body and the sheet. The efficacy of the turning force produced is dependent upon several external factors, including the size of the patient and the texture of the fabrics comprising the draw sheet and patient apparel. A more predictable and controllable turning mechanism is, therefore, desirable. Additional drawbacks to the device just described include its bulkiness, which tends to obstruct patient care and also obstructs patient transfers into and out of the bed. Special linens are also required and would need to be changed frequently in cases of incontinence. Because of the roller mechanism, changing linens is a time consuming chore.

Alternatively, the bed assembly itself may turn and deposit the immobilized patient onto a separate mattress. An example of a turnover bed assembly is disclosed in U.S. Pat. No. 3,827,089, issued to Grow. The assembly includes a mattress which is movably supported on a rotationally movable carrier frame. An invalid who is lying on the lower mattress, and who wishes to change position from face down to face up, or vice versa, is strapped by a caregiver to the mattress upon which he presently lies. Then, upon engagement of the controls by the caregiver, the assembly is rotated one quarter revolution. The mattress upon which the patient had been lying is secured for movement towards the opposite mattress, then a succeeding quarter turn positions the patient in the desired new position on the opposing mattress. The mattress upon which the patient had previously been lying is then retracted on its support rails. The dual mattress apparatus is very bulky and quite expensive. Also, it has limited utility, since the patient is either deposited face-up or face-down. To shift a patient to one side or the other still requires manual intervention by the caregivers.

Yet another variant of an apparatus for positioning bed-fast patients is provided in U.S. Pat. No. 4,872,226, issued to Lonardo. This apparatus includes a rectangular bed pad which dwells on the bed surface and extends at least from above the shoulders of the patient to a point at least below the hip areas. It is fitted with a pair of straps which are secured to the pad and extend transversely across the pad in substantial alignment with the shoulders and hip areas of the patient. Various straps are attached to the pad to effect movement of the patient into a preselected position by pulling at the straps. This device is not mechanized and relies upon the caregiver to pull on handgripping loops which are positioned at various points in the straps. These loops may be latched onto specially designed receptacles on the rails of the bed to maintain the patient in a desired tilted position. Thus, the patient is once again positioned by manual effort from caregivers, which is strenuous and time consuming and may lead to back injury and insurance or worker's compensation claims. Consequently, it frequently occurs that patients are not turned as often as they should be, which results in serious health problems, such as bed sores.

It is accordingly a principal object of the present invention to provide a new and improved method and apparatus to reduce the manual effort required of caregivers by providing a device which will predictably and easily manipulate the positioning of a mobility impaired person in bed.

Another object of the present invention is to provide a new and improved method and apparatus for positioning patients which may be operated by a single caregiver or by the patient.

It is yet another object of the present invention to provide a new and improved method and apparatus for positioning patients which is not uncomfortable or painful to the patient as his position is shifted.

A further object of the present invention is to provide a new and improved apparatus which is low-cost and easy to install on existing bed equipment.

A still further object of the present invention is to provide a new and improved method for safely turning a mobility impaired patient using a patient corset operatively coupled to an electric motor or other suitable drive mechanism.

Another object of the present invention is to provide a new and improved method and apparatus for turning a mobility impaired patient which does not require bulky equipment, hence it is not obtrusive and does not interfere with patient care or with transferring the patient into or out of bed.

It is yet another object of the present invention to provide a new and improved method and apparatus for turning a mobility impaired patient that does not require the use of specially designed bed linens or draw sheets.

A still further object of the present invention is to provide a new and improved method and apparatus for turning a mobility impaired patient that utilizes existing hospital beds and standard retractable bed rails, wherein the bed rail or a detachable bed rail guard serves as a passive roller.

SUMMARY OF THE INVENTION

The foregoing objects and advantages of the invention are achieved by providing a motor driven patient positioning device which uses flexible straps to exert pressure on a patient corset, without exerting undue pressure upon the patient's body. The drive unit may be operated by either the patient or by a caregiver, and it includes various safety features to prohibit undesired movement, yet allows the patient to be either rotated or shifted laterally on the bed. Consequently, the present invention enhances both patient safety and patient care.

In the preferred embodiment, a patient is fitted with a specially dimensioned, flexible patient corset which is appropriately sized to encompass a portion of his/her hips and lower torso. A pair of flexible straps, preferably of woven synthetic composite, either attach directly to the patient corset in the region of the patient's left and right sides and extend therefrom, or are attached to a pair of detachable patient corset straps having tabs with Velcro® type fasteners, each of which are secured around a buckle on the straps. Irrespective of the strap configuration used, each patient corset strap passes beneath the patient before reappearing on the patient's opposite side. The strap then passes over its corresponding bed rail and, eventually, over a roller in the drive unit. From the drive unit rollers, each strap then passes to a drive motor or an associated take-up assembly.

One example of a suitable drive arrangement includes a traveling screw block assembly. This arrangement may include a pair of rollers which engage first and second straps. From each roller, each of the straps doubles back with one end attached to a stationary mounting plate and the other leading to the patient corset. The drive unit assembly includes a lead screw journaled between the mounting plates. It is driven by a reversible gear motor capable of turning the lead screw in either direction. A polished guide bar affixed to and extending between the mounting plates passes through a bore in the traveling screw block itself and prevents rotation of the screw block as the lead screw is driven. The rotary motion of the lead screw is thus converted into a translational linear motion of the traveling block, which produces tension on the corset straps. Furthermore, the double roller system described in reference to the preferred embodiment results in a doubling of the strap movement over that of the screw block itself. One foot of travel by the screw block will result in a two foot movement of the straps, thus providing a greater range of movement for the patient.

Although an embodiment utilizing the motor plus traveling block assembly is preferred, any suitable hydraulic, pneumatic, magnetic or direct drive apparatus which produces predictable, controllable tension in the corset straps may be used. For example, as an alternative to the preferred traveling block assembly having a polished guide rod to preclude rotation, it is possible to use a slotted tube which provides a guideway in which the traveling block can slide. The guideway prevents rotation of the traveling block.

In another alternative embodiment, the drive assembly includes a gear reduction electric motor that drives a double spool which is mounted directly to the motor's shaft. The strap from one side of the bed is wound onto its spool clockwise, while the strap coming to the drive unit from the other side of the bed is wound onto its spool in counter-clockwise fashion. Thus, as the motor rotates in one direction, one spool unwinds its strap while the other spool is winding up its strap.

In comparison with prior art devices, this invention provides a more predictable and controllable mechanism for turning a patient, which requires minimal cost and caretaker effort.

The drive unit may be mounted beneath the bed frame by any suitable hangers that are braced to prevent linear displacement of the drive unit during operation. In one embodiment, the hangers are adjustable in length and secure the drive assembly to the bed frame with thumbscrews or bolts. The hanging brackets are dimensioned to fit the bed frame to support the drive unit underneath the mattress frame where it is out of the way of nursing attendants. The entire drive unit is preferably contained within an enclosed housing which is adjustable in its length, keeps the drive unit free of dirt and debris, and protects caregivers or patients from accidental contact with the drive mechanism.

The aforementioned objects and advantages of the invention will become subsequently apparent and reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENT

Figure 1:
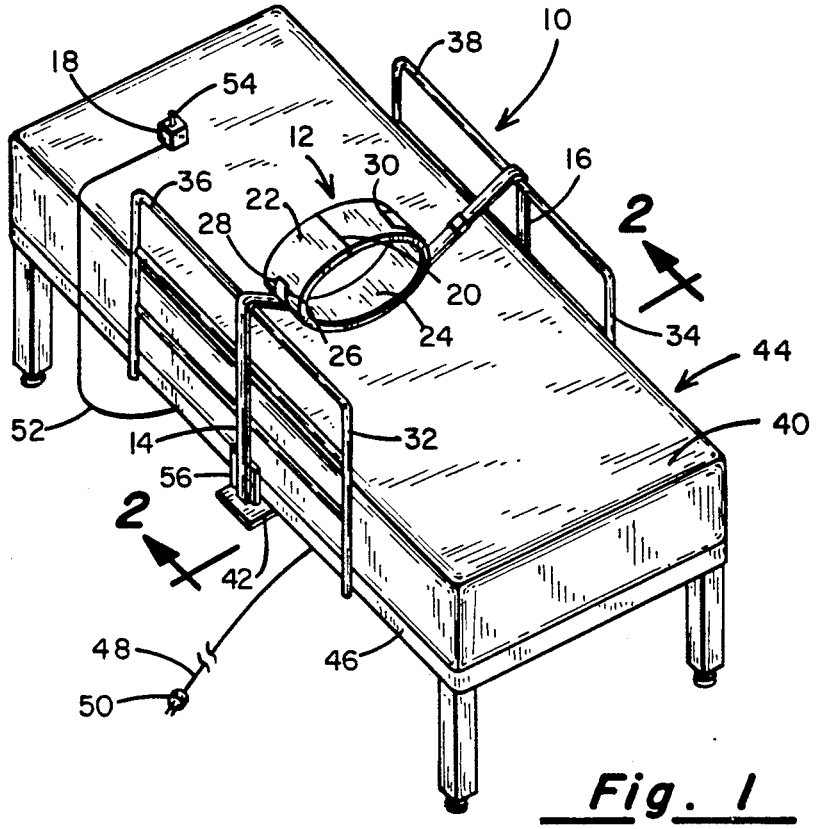
FIG. 1 shows a perspective view of a hospital bed on which the preferred embodiment of the present invention is installed.

A preferred embodiment of the patient positioning device is shown in FIG. 1. Generally depicted as 10, it is adapted for use with a variety of existing patient beds. As will be explained further below, the bed is preferably equipped with conventional safety railings, such as 32 and 34. The patient positioning device comprises a patient corset 12 and a pair of flexible straps 14 and 16 affixed to the corset. As described more fully hereinafter, the straps each terminate at a take-up assembly which is driven by a motor. Either the patient or a caregiver may operate the motor using control unit 18 electrically coupled to the motor, thus causing tension to be exerted upon one of the straps, translating the patient into a desired new position on the bed.

The patient corset 12 is available in a variety of sizes to accommodate a particular patient's torso and relevant physical disability. It includes a Velcro® closure at cuff opening 20. Preferably, it is constructed of a bi-layer fabric. The exterior layer 22 of the corset is preferably a flexible, stretch-resistant fabric, such as rip-stop nylon or a tightly woven synthetic or siliconized material having reduced friction properties, allowing the corset to easily slide relative to the bed sheets. This reduces the force required on the strap, facilitates the change of position, and improves patient comfort. The interior layer 24 of the corset is preferably soft and absorbent material, such as flannel or medium weight canvas, for increased patient comfort.

The straps 14 and 16 are preferably constructed of heavy-duty webbing, having no seams or buckles along their length, and are attached to the corset 12 in regions corresponding to the sides of the patient's torso. With no limitation intended, an example of suitable webbing includes a woven synthetic covering adhered to both sides of an amorphous synthetic core, such as Seigler USA TT2 belting. Alternatively, the straps may be made of a woven synthetic or natural fiber webbing or fabric, leather, flexible plastic or synthetic materials, or of a fabric or webbing reinforced with steel or other metal mesh. The straps may be sewn, as at 26, riveted, fused, or otherwise permanently affixed to the regions 28 and 30 of the corset.

The straps 14 and 16 are oriented so that when they are laid flat along the circumference of the corset, they can extend underneath the patient's body toward bed rails 32 and 34. The top rails 36 and 38 of each bed rail assembly 32 and 34 are positioned somewhat higher than the top surface of mattress 40 when the bed rails are in their "up" position and the straps are routed over the top rail thereof. An elevated bed rail creates an angle between the mattress and strap. This serves to provide a blended movement of lateral shifting and rotation of the patient about his or her mid-axis. Having the strap pass over an elevated rail also provides a measure of lift to the patient and thereby additionally reduces the friction of the patient against the bed.

Each of straps 14 and 16 extends toward the floor along the outer sides of the bed rails 32 and 34.

Figure 2:
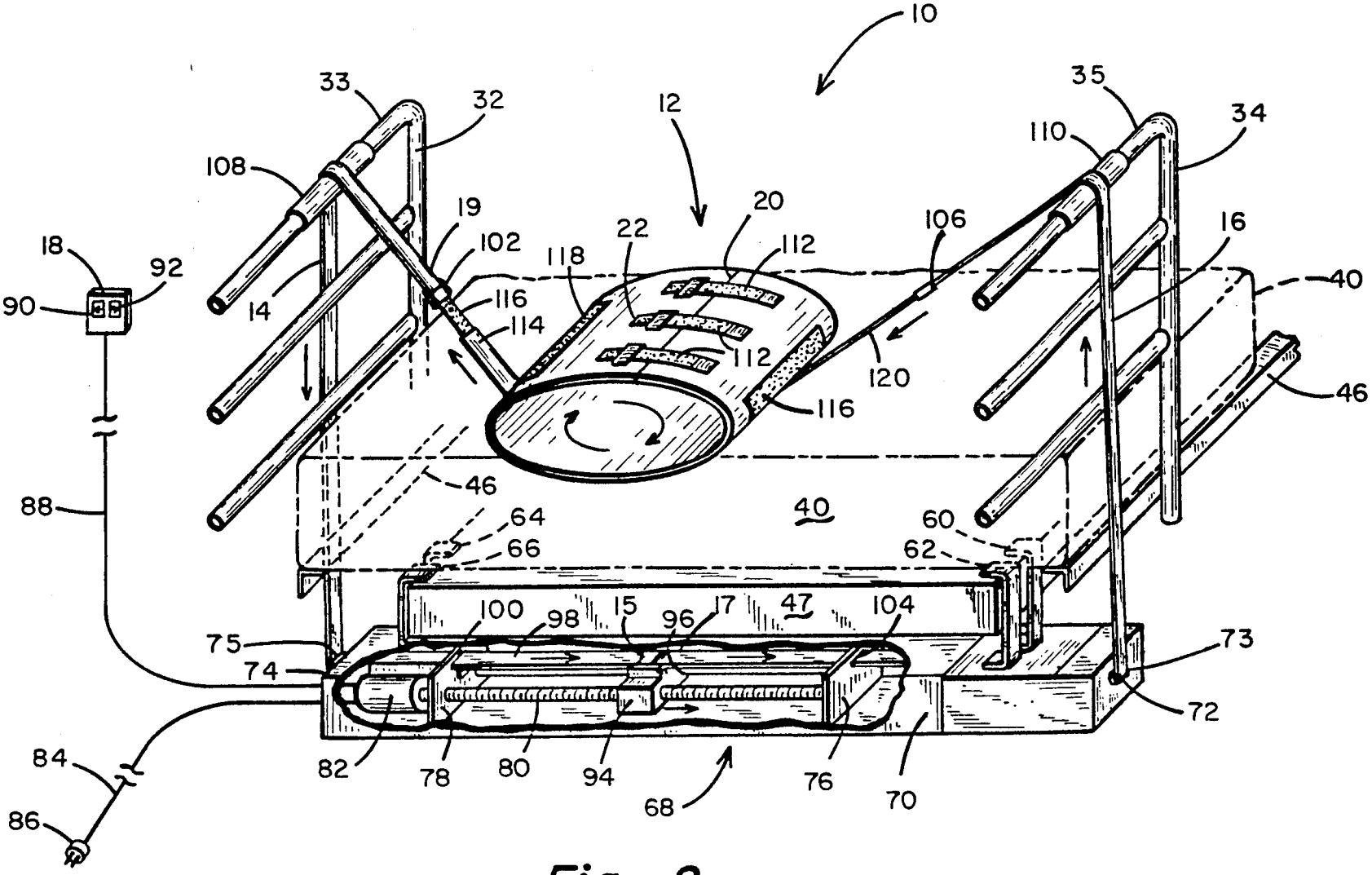
FIG. 2 shows a perspective, sectioned view of the embodiment of FIG. 1.

As is shown in FIG. 2, the bed frame 46 supports a mattress 40 which is shown in phantom line. The frame is conventional and fabricated principally from angle iron. The safety side rails 32 and 34 are mounted on the bed frame in a conventional fashion so that they can be raised and lowered as needed. Suspended beneath the frame members 46 of the bed by hangers 60–66 is a drive assembly indicated generally by numeral 68. The hangers comprise first and second elongated rigid metal straps which are joined together by suitable fasteners so as to allow the drive assembly 68 to be suspended parallel to the underside of the mattress with a predetermined distance therebetween. In the case of a hospital-type bed, having the capability of elevating the head and foot thereof, the frame that supports the mattress is movable and is, in turn, supported by a stationary frame 47. With such a bed, the drive assembly 68 is suspended by the straps from the stationary frame 47, not the movable one. The drive assembly includes a box-like, extendable, variable-length housing 70 having slots 72 and 74 at opposed ends thereof through which the straps 14 and 16 may pass. Rollers 73 and 75 are journaled for rotation proximate the slots 72 and 74 for redirecting the strap with low friction.

Contained within the box or housing 70 are a set of parallel, spaced-apart bearing plates 76 and 78. Rotatably journaled between those bearing plates is a lead screw 80 which is adapted to be driven by a reversible motor 82, also contained within the housing 70. Exiting the housing is a power cord 84 which terminates in a plug 86 for coupling motor 82 to a supply voltage source. Also exiting the housing 70 is a cord 88 leading to the control device 18. The device 18 may include a pair of push buttons 90 and 92, allowing the patient and/or attendant to select the direction of rotation of the motor 82.

Engaging the threads on the lead screw 80 is a travel block 94 which includes an unthreaded bore 96 in which is slidingly received a smooth cylindrical rod 98. The rod 98 is supported at opposite ends by the bearing plates 76 and 78 and it functions to prevent the travel block 94 from rotating when the lead screw 80 is driven. The ends 15 and 17 of the straps 14 and 16, respectively, may be affixed to the travel block 94. The strap 14 extends to the left when viewed in FIG. 2 and passes through a slot 100 formed in the bearing plate 78 and from there it exits the left end of the housing 70 via slot 74, is directed over the surface of a roller 75 and extends upward along the side of the bed and over the top rail 33 of the bed rail assembly 32. The strap 14 may terminate at its end 19 in a buckle member 102 or, alternatively, may be affixed directly to the corset. In a similar fashion, the strap 16 is routed through a slot 104 formed in the bearing plate 76 and then through the slot 72 in the rightmost end of the housing 70. From there, it passes about the roller 73 mounted to the housing 70. The strap then extends upward along the side of the bed rail assembly 34 and over its top rung 35, ending in a buckle 106 or attaching directly to the corset 12. It has been found expedient to install split tubing segments 108 and 110 around the upper rails 33 and 35 which are sufficiently loosely fitting to permit rotation thereof, and thus act to prevent wear and damage to the bed rail assembly by the rubbing of the belt.

With continued reference to FIG. 2, it can be seen that the corset member 12 is split along line 20, allowing the corset to be wrapped around a patient's hips and abdomen. Hook and loop closure strips 112 provide a convenient way of securing the corset in place about the patient, although a zipper, buckles or snaps may also be used for this purpose.

If buckles 102 and 106 are to be used, a further strap 114 is looped through the buckle 102 and then secured using a hook and loop fastener 116. The other end of the strap 114 can be secured at alternate locations to the outer surface 22 of the corset 12. In a first arrangement, the strap 114 may pass under the corset 12 and have its free-end affixed to the Velcro® pad 116 on the opposite side of the corset or, alternatively, the free end of the strap 114 can be affixed directly to the Velcro® pad 118. Likewise, a further strap 120 is appropriately either affixed to the buckle 106 or directly to the corset 12 and it may extend either beneath the corset such that its free end attaches to the Velcro® pad 118 or, alternatively, the strap 120 may attach at its free end directly to the pad 116 on the same side of the corset.

Those skilled in the art will appreciate from what has been heretofore described that when the arrangement in which the straps 114 and 120 pass under the corset and the patient which it encircles, when the motor 82 is energized, the traveling block 94 will move to the left or the right along the lead screw 80, depending upon the direction of rotation of the motor. In either event, one of the straps 14 or 16 will be tensioned or taken up as the other is loosened or played out, thereby effectively rotating the corset and the patient. When the straps 114 and 120 are respectively joined to the Velcro® pads 118 and 116, movement of the travel block 94 by the lead screw 80 will effect translational movement of the patient, unaccompanied by rotation.

Because of the manner in which the straps 14 and 16 are routed over the top rung of the bed rail assemblies 32 and 34, as the patient is pulled toward one of the bed rails, the angle of pull begins to increase and imparts a steadily increasing force of rotation. The patient, thus, experiences a blended type of movement that is first primarily a lateral shift, but in its second phase becomes more rotational. This transition occurs smoothly and gradually, producing an improved sense of comfort and a more effective turning process when compared to having the strap in a horizontal orientation.

The straps 114 and 120 may comprise woven nylon webbing and rather than being affixed to the body of the corset by Velcro® hook and loop fasteners, they may also be sewn in place.

Figure 3:
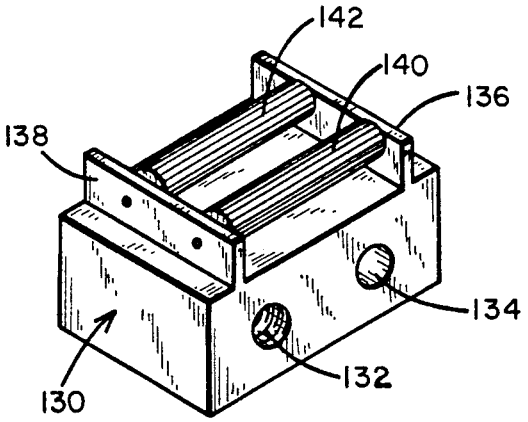
FIG. 3 shows an enlarged perspective view of the traveling screw block of FIG. 2.

FIG. 3 depicts an alternative traveling block member which may be used in place of the traveling block 94 illustrated in FIG. 2. The traveling block 130 in FIG. 3 has a threaded bore 132 into which is fitted the lead screw 80. The smooth polished shaft 98 is arranged to pass through the smooth bore 134 which extends parallel to the threaded bore 132. Projecting upwardly from the top surface of the block 130 are integrally formed flanges 136 and 138 which are in parallel, spaced apart relationship with respect to one another. Rotatably mounted between the flanges 136 and 138 are rollers 140 and 142. Rather than having the ends of the straps 14 and 16 secured directly to the travel block as in the embodiment of FIG. 2, when the travel block shown in FIG. 3 is used, the strap 14 will be looped beneath the roller 142 and then over it with the free end of that strap being affixed to the left bearing and plate 78 of the housing 70. In a similar fashion, the end of the strap 16 is routed beneath and then over the roller 140 before being secured to the right bearing plate 76 of the housing 70. The use of the traveling block 130 of FIG. 4 on the lead screw 80 results in a doubling of the strap movement when compared to the arrangement shown in FIG. 2. Thus, one foot of movement of the travel block 130 along the lead screw will result in the straps 14 and 16 being moved two feet.

Figure 4:
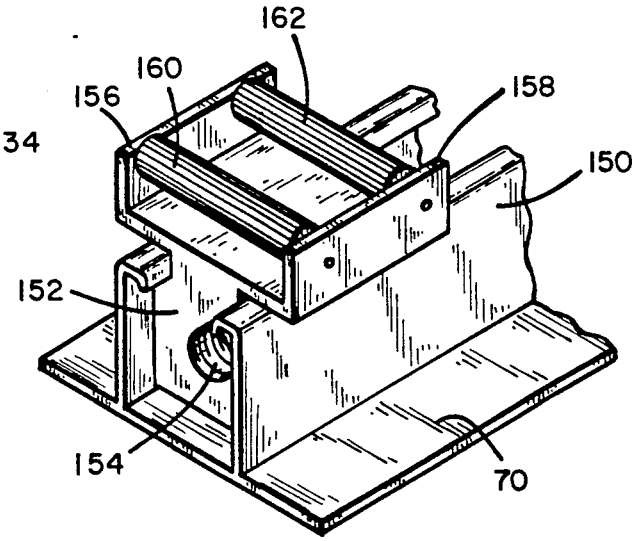
FIG. 4 shows a perspective view of an alternative screw block for use in the embodiment of FIG. 2.

To avoid the necessity of having the polished rod 98 cooperating with a separate bore in the travel block to prevent rotation of the travel block as the lead screw rotates, the configuration shown in FIG. 4 may be substituted. Integrally formed with or otherwise attached to the floor panel of the box-like housing 70 is a channel tube 150 of rectangular cross section. The channel tube 150, may comprise, for example, a length of Unistrut® P1003 tubing which runs substantially the entire length of the housing 70. The travel block 152 is molded, machined or otherwise formed to slide within the confines of the sidewalls of the channel 150 when the lead screw fitted into the threaded bore 154 is driven by the motor 82. As in the embodiment of FIG. 3, the travel block 152 includes a pair of parallel, spaced apart flanges 156 and 158 between which are journaled rollers 160 and 162 over which the straps 14 and 16 are routed as previously described when FIG. 3 was explained.

FIGS. 5–8 illustrate alternative drive arrangements for simultaneously extending a first strap while retracting a second. Thus, these drive arrangements may be used in place of the lead screw and travel block combination illustrated in FIG. 2.

Figure 5:
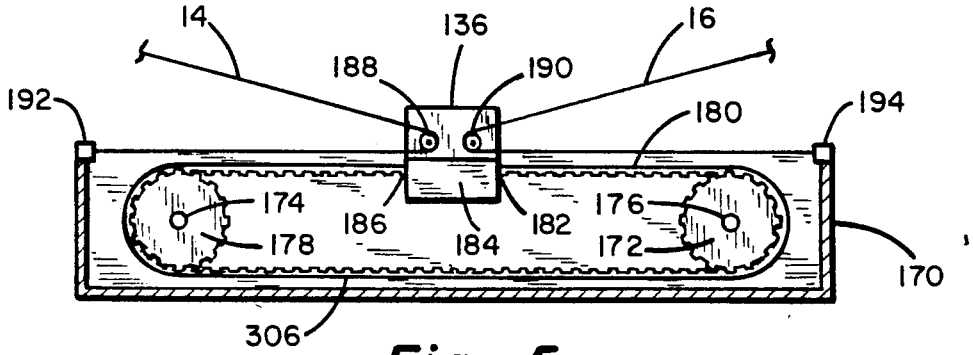
FIG. 5 shows an end view of another drive assembly which can be used with the apparatus of FIG. 1.

Referring to FIG. 5, there is schematically shown a housing 170 containing a motor driven sprocket wheel 172 disposed proximate one side wall thereof. Journaled for rotation about a shaft 174, extending parallel to the motor shaft 176, is an idler sprocket 178 and surrounding each of the two sprockets is a belt or chain 180 having a first end 182 thereof affixed to the travel block 184 and its opposite end 186 and is likewise joined to the travel block on its opposite side surface. Supported by the travel block 184 are first and second rollers 188 and 190. Looped about the roller 188 is the strap 14 whose end is secured to the housing wall as at 192. Likewise, the strap 16 passes about the roller 190 and has its end affixed to the other wall at 194.

It is apparent that when the drive sprocket 172 is rotated by the motor in a clockwise direction, the travel block 184 will move to the right when viewed as in FIG. 5, thereby tensioning strap 14 and relaxing the tension on strap 16. The opposite ends of the straps 14 and 16 being joined to the corset member 12, rotation and/or translation of the patient will take place.

Figure 6:
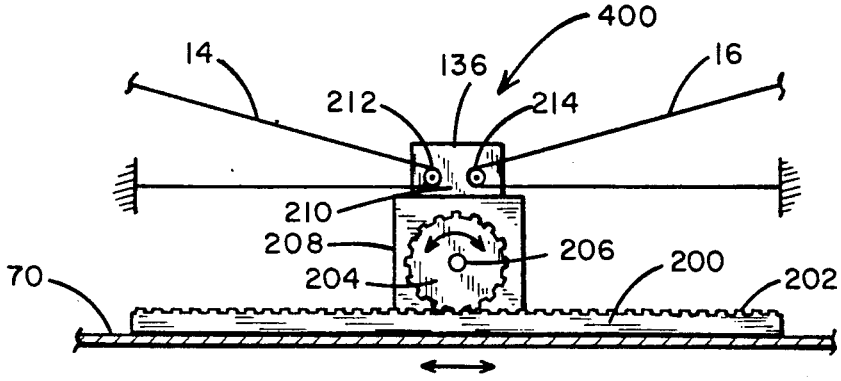
FIG. 6 shows an end view of a rack and pinion drive assembly which may be used with the apparatus of FIG. 1.

FIG. 6 illustrates a rack and pinion construction for simultaneously tensioning one of the straps 14 or 16 while relaxing the other. The rack is identified by numeral 200 and it includes a plurality of teeth 202 on the upper surface thereof. The rack is fixedly mounted within the confines of a housing, such as housing 70 in FIG. 2. Cooperating with it is a pinion gear 204 coupled to a shaft 206 which is, in turn, journaled for rotation in a travel block 208. A motor (not shown) is also secured to the travel block for driving the shaft 206. A bracket 210 affixed to the travel block 208 journals a pair of rollers 212 and 214 about which the straps 14 and 16 are again routed.

When the motor is actuated to drive the pinion gear 204, the rack 200 being stationary, will cause the travel block 208 to "walk" along the length of the rack in a direction depending upon the direction in which the motor is rotating. As was true with the prior embodiments, the movement of the travel block 208 will cause tension to be applied to one of the straps 14 or 16 as the other is relaxed or loosened.

Figure 7:
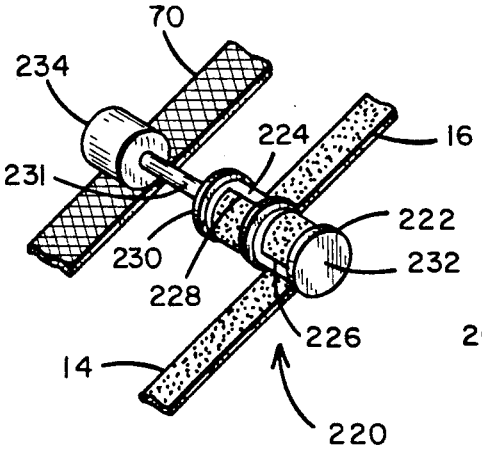
FIG. 7 shows a perspective view of an alternative embodiment for the drive system which can be used with the present invention.

FIG. 7 shows a perspective view of yet another strap take-up mechanism for use with the embodiments of FIGS. 1 and 3. Generally designated as 220, it includes a pair of cylindrical drums 222 and 224. Strap 14 may be secured to roller 222 and strap 16 to roller 224. One example of the manner in which the straps may be secured to the drums includes having slots 226 and 228 disposed longitudinally along each cylinder. A metal tab (not shown) is crimped at the free ends of each of straps 14 and 16, and has a cross-sectional area greater than the size of the slots 226 and 228. The straps can be disposed within these slots by sliding the metal tabs within drums 222 and 224, respectively, then snap ring retainers 230 and 232 are installed. A shaft 231 extends into the drums 222 and 224 and affixes them to a gear reduction electric motor 234 mounted on housing 70. Thus, when strap 14 is wound on spool 222, strap 16 will be released from spool 224 and vice versa. At this time, the patient will experience a downward pull at position 30 of FIG. 1, which will cause the patient to be turned. towards the direction of bed rails 34 as the corset moves through a predetermined arc of rotation. Simultaneously, the force on strap 16 is released, so that the patient may be pivoted upwards at position 28 of FIG. 1, and lie with his back towards bed rails 32. Consequently, in this embodiment, the patient is turned in the direction opposite from that of the spool on which the strap is being rolled.

Figure 8:
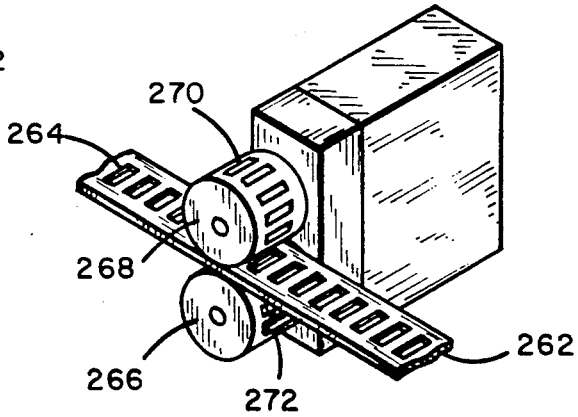
FIG. 8 shows a perspective view of yet another alternative drive system for effecting translation and/or rotation of a bedridden patient.

FIG. 8 shows yet another alternative drive system which may be used to manipulate a patient in a bed. A belt 262 includes a plurality of regularly spaced slots 264 and is positioned between a pair of pinch rollers 266–268. Pinch roller 268 includes radially spaced grooves 270 which are dimensioned to receive mating projections or teeth 272 extending from the surface of complimentary pinch roller 266. The pinch rollers 266 and 268 are both powered by a motor to rotate in synchronism. In use, the teeth on pinch roller 266 project through slots 264 in the belt 262 and into the grooves 270 to secure the belt as the motor provides the driving force to pull the flexible notched belting as required. As one pinch roller turns clockwise, the other turns counterclockwise. Alternatively, only one pinch roller may be powered and the other is urged forward by engagement of the teeth in the slots and grooves. Although shown having a single slotted belt 262, a single belt, or dual belts as shown in FIG. 5, may also be used to rotate the corset. Also, by properly designing the pinch roller assembly, a smooth belt rather than a slotted one can be used. Also, the pinch rollers may be smooth, with the teeth being eliminated.

The gear reduction electric motor used with the present invention may operate on standard 110 volt current. To protect the patient or caregiver from electrical hazards, the motor is controlled by a low voltage switch and relay system that isolates the switch operator from the voltage that actually drives the motor. Other drive systems applicable to the present invention include chain and sprocket drives, belt drives, cable/spool drives, hydraulically driven units, linear motor systems or simple gear type arrangements that could drive a rigid bar in either direction. All the mechanically driven systems could be driven by fixed motor or hand held portable motor drives. Alternatively, a manually driven version could be operated by a simple hand crank.

The control unit 18 includes a switch utilizing a minimal amount of current, also to enhance patient safety. The switch is depicted in FIG. 1 as toggle switch 54 or in FIG. 2 as push buttons 210 and 212, but suitable alternatives include a self-centering toggle, a joystick, alternative push buttons or any other conventional switch approved for patient safety.

Additional safety features include low voltage switches on the hand held controls, mercury switches to allow operation of the device only when the bed is horizontal, and safety guides to keep fingers, clothes, and garments from being pinched between the bed rails and straps. To enhance patient safety still further, the design also includes limit switches which establish the total strap travel distance that may be pre-set or adjustable. Excessive pulling force on the patient via the strap or straps may be limited by the use of Velcro® closures, torque limiters or slip clutches on the drive unit, or by the use of fabrics and seams designed to rip apart under excessive tension forces.

A significant advantage of the patient positioning device is that its simple, inexpensive parts can be used to retrofit any existing patient bed and bed rail system. It merely requires that the bed rails be securely affixed to the bed frame and strong enough to withstand the pressure produced by movement of the straps as they pull against the weight of the patient. The device is also not limited to a particular motor or motor system or a particular roller guide configuration. Furthermore, although various alternative take-up systems have been described, no limitation to any apparatus described therein is intended. One skilled in the art will readily recognize that any take-up apparatus that may be positioned under a conventional patient bed and is capable of withstanding the tension levels required for movement of a mobility impaired patient will meet the requirements of the present invention.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices and that various modifications, both as to equipment details and operating procedures, can be accomplished without departing from the scope of the invention itself.

What is claimed is:

1. A patient positioning device for attaching to a hospital bed of the type including a stationary bed frame, a movable bed frame joined to said stationary bed frame, a mattress supported by said movable bed frame and side rails for preventing a patient from rolling onto the floor, comprising:

(a) patient corset means for wrapping around the torso of a patient;

(b) at least one elongated flexible strap means, having first and second ends, opposably coupled to said patient corset at locations corresponding to the patient's sides;

(c) drive means disposed beneath said bed frame and coupled to said strap means for applying a pulling force to effect movement of said corset means; and (d) control means attached to said drive means for regulating the movement of said strap means.

2. The patient positioning device of claim 1, wherein said drive means includes a reversible electrical motor.

3. The patient positioning device of claim 1, wherein said corset means further includes a first and a second corset strap, each having a first end and a second end, and said first ends are each attached to said corset means, and said second ends of each of said corset straps is attached to one of said first and second ends of said first strap means.

4. The patient positioning device of claim 1, wherein said corset means further includes an outer surface of friction-reducing fabric.

5. The patient positioning device as in claim 1 wherein said drive means comprises:

(a) an elongated, box-like housing suspended from said stationary bed frame beneath said mattress and extending substantially the entire width dimension of said bed;

(b) a lead screw journaled for rotation within said housing;

(c) a traveling block operatively coupled to said lead screw for translational movement therealong as said lead screw is rotated;

(d) a reversible electric motor disposed within said housing in driving relation to said lead screw; and (e) said elongated flexible strap means being coupled to said traveling block.

6. The patient positioning device as in claim 1 wherein said drive means comprises:

(a) an elongated, box-like housing suspended from said stationary bed frame beneath said mattress and extending substantially the entire width dimension of said bed;

(b) first and second sprockets journaled for rotation within said housing about a pair of axes extending transverse to the length dimension of said box-like housing proximate the opposed ends thereof;

(c) a reversible electric motor disposed within said housing and coupled in driving relation to one of said first and second sprockets;

(d) a flexible band entrained about and engaged by said first and second sprockets;

(e) a traveling block operatively coupled to said flexible band with said elongated flexible strap means being coupled to said traveling block.

7. The patient positioning device as in claim 1 wherein said drive means comprises:

(a) an elongated, box-like housing suspended from said stationary bed frame beneath said mattress and extending substantially the entire width dimension of said bed;

(b) an elongated gear rack contained within said housing and extending the length thereof;

(c) a traveling block member;

(d) a pinion gear journaled for rotation in said traveling block member, said pinion gear engaging said gear rack;

(e) motor means affixed to said traveling block in driving relation to said pinion gear; and (f) said elongated flexible strap means being coupled to said traveling block.

8. A patient positioning device as in claim 1 wherein said drive means comprises:

(a) an elongated, box-like housing suspended from said stationary bed frame beneath said mattress;

(b) drum means journaled for rotation within said housing about a shaft extending parallel to the longitudinal axis of said bed;

(c) a reversible electric motor contained within said housing and coupled to said shaft; and (d) means for coupling said flexible strap means to said drum means to impart translational movement to said flexible strap means when said drum means is driven by said motor.

9. The patient positioning device as in claim 8 wherein said drum means includes a plurality of equally radially spaced projections on a peripheral surface thereof and said elongated flexible strap means includes a plurality of longitudinally spaced openings over a predetermined length thereof adapted to be sequentially engaged by said projections as said drum means is rotated.

10. The patient positioning device of claim 1, further including a first and second side rail protector disposed means between a predetermined portion of said side rails and said strap means.

11. The patient positioning device as in claim 1 wherein:

(a) said flexible strap means is comprised of a woven polymer webbing.

12. A patient positioning device for attaching to a hospital bed of the type including a bed frame and a mattress supported by said bed frame comprising:

(a) a patient corset means for wrapping around the torso of a patient, said patient corset including:

(i) a first and a second flexible strap means, each having a first end and a second end, said first ends being attached to said patient corset along opposed side surfaces thereof for applying rotational force to said corset, (ii) a first strap guide means coupled to said bed frame for routing said first strap means along a first predetermined path;

(iii) a second strap guide means coupled to said bed frame for routing said second strap means along a second predetermined path;

(iv) a reversible motor means coupled to said second ends of said first and second strap means for applying a pulling force on one of said first and second strap means, and (v) a motor control means attached to said reversible motor means, for regulating the movement of said first and second straps means.

* * * * *